US005863256A

United States Patent [19]

MacLean et al.

[11] Patent Number: 5,863,256

[45] Date of Patent: Jan. 26, 1999

[54] PORTABLE PUTTING SURFACE

[75] Inventors: John J. MacLean, 11401 110th Ave. North, Largo, Fla. 33778; Denis Cavanagh, Tampa, Fla.

[73] Assignee: John J. MacLean, Largo, Fla.

[21] Appl. No.: 854,684

[22] Filed: May 12, 1997

[51] Int. Cl.[6] ..... A63B 69/36

[52] U.S. Cl. ..... 473/160; 473/162

[58] Field of Search ..... 473/157–164

[56] References Cited

U.S. PATENT DOCUMENTS

| | | | |
|---|---|---|---|
| 1,612,291 | 12/1926 | Jackson . | |
| 1,897,289 | 2/1933 | Wieden | 473/160 |
| 3,508,756 | 4/1970 | Bedford, Jr. . | |
| 3,727,917 | 4/1973 | MacLean . | |
| 3,735,988 | 5/1973 | Palmer et al. | 473/162 |
| 3,858,887 | 1/1975 | Wallin . | |
| 3,892,412 | 7/1975 | Koo . | |
| 4,429,881 | 2/1984 | Barrett | 473/162 |
| 4,647,046 | 3/1987 | Hurt | 473/162 |
| 4,875,682 | 10/1989 | Paolillo . | |
| 5,002,280 | 3/1991 | Hines . | |
| 5,171,016 | 12/1992 | Kamal . | |
| 5,318,303 | 6/1994 | Kim . | |
| 5,429,368 | 7/1995 | Adams . | |

FOREIGN PATENT DOCUMENTS

| | | | |
|---|---|---|---|
| 2056059 | 5/1993 | Canada | 273/176 F |
| 358362 | 10/1931 | United Kingdom | 273/176 F |
| 2121297 | 12/1983 | United Kingdom . | |

*Primary Examiner*—Mark S. Graham
*Attorney, Agent, or Firm*—Richard C. Litman

[57] ABSTRACT

A portable putting surface is formed of a plurality of separate panels each having opposite left and right side rails removably secured thereto. The side rails in turn have mating ends which are used to assemble the panels into a continuous surface. A continuous length of artificial grass or turf material (e. g., Astroturf, tm) is used to cover the panels to form a reasonably realistic putting surface. The side rails each include a slope adjusting screw, thus enabling the left and right sides of the surface, and different panels of the surface, to be adjusted independently of one another in infinitesimally small increments as desired. The present putting surface may be used to simulate side hill lies on a sloping green, and/or may be used to duplicate very closely the slope of any particular green, from any approach direction. The surface assembles and disassembles easily in a matter of a minute or so, and may be packed into an extremely small package for shipment or storage, as desired.

14 Claims, 4 Drawing Sheets

PORTABLE PUTTING SURFACE

BACKGROUND OF THE INVENTION

1. Field of the Invention

The present invention relates generally to the game of golf, and more specifically to a portable putting surface formed of a plurality of individual panels removably coverable with a continuous covering of simulated putting green. The heights of various portions of the panels and surface are independently adjustable so that upward and/or downward slopes may be provided, as well as sloping one or more of the panels to one side or the other to create a left and/or right slope along the path of the surface.

2. Description of the Related Art

The game of golf has enjoyed ever increasing popularity as the leisure time available to people has increased over the years. One of the attractions of the game is that while the basic principle is extremely simple, the various elements involved in the play of the game are nearly infinite, with practically every shot being unique. Many players tend to take the game quite seriously, and as a result, numerous devices have been developed to aid players, from training aids to more efficient clubs to higher performance golf balls to better shoes and other equipment, etc.

One type of device which has been developed is the simulated putting green, or a portion thereof, many of which have been constructed to be portable so a player may set up the simulated green for practice in a basement, recreation room, back yard, etc., and polish his or her putting game accordingly. However, as noted above, the natural lie of the terrain of a golf course leads to a practically infinite number of different situations which may be encountered by a golfer, and most such artificial devices do little to simulate some of the irregularities which can occur on a green, such as different slopes. While some earlier devices have seen the need to provide different slopes to simulate such conditions, such devices are generally cumbersome to set up, have limited or no adjustability, and/or have some other deficiency which makes their utility less than ideal.

Accordingly, a need will be seen for a portable golf putting surface which is formed of a plurality of separate sections with a continuous length of simulated golf green material removably installed thereover. The separate sections are each independently adjustable for height on each side thereof, thus enabling a user of the device to set up upward, downward, left, and/or right slopes with the present portable surface. The assembly and height or slope adjustment of the present device is accomplished quickly and easily in comparison to earlier devices of the related art, by various novel attachment and adjustment means. A discussion of the related art known to the present inventor, and its differences and distinctions from the present invention, is provided below.

U.S. Pat. No. 1,612,291 issued on Dec. 28, 1926 to George P. Jackson describes an. Indoor Golf Game having a raised area around the cup, and a ramp having a fixed slope leading to the raised cup area. The raised area is adjustable to provide varying slopes in different directions, but the adjustments are not accessible from the upper side of the device. The device is cumbersome to set up, as several flexible metal strips must be assembled with several adjustable jackscrews in a matrix, then covered with burlap and carpeting. No side rails are provided by Jackson for his putting area, whereas the present invention includes side rails which serve to connect the various panels together and also to hold externally accessible adjustment screws.

U.S. Pat. No. 3,508,756 issued on Apr. 28, 1970 to William A. Bedford, Jr. describes a Variable Surface Putting Device wherein a flexible sheet of material is resiliently suspended from a tubular frame. The frame includes a plurality of upstanding members, with the resilient connections between frame and flexible sheet being independently vertically adjustable on each of the upstanding members. The present portable putting surface comprises a plurality of individual panels temporarily overlaid with a continuous sheet of simulated putting green, whereas the surface of the Bedford, Jr. device is a thin, flaccid, freely suspended sheet of material. Moreover, Bedford, Jr. fails to disclose any side rails or other means of retaining a golf ball on the surface of his flaccid sheet, whereas the present invention includes such side rail ball retaining means.

U.S. Pat. No. 3,727,917 issued on Apr. 17, 1973 to George D. MacLean describes a Variable Contour Golf Putting Device comprising a plurality of hingedly connected panels each having a side rail affixed thereto. The hinges are attached to alternating upper edges of the side rails and alternating lower surfaces, so the device may be folded in a series of Z bends (accordion folds) for storage. The device is limited in comparison to the present invention, as it is relatively bulky when stored due to the height of the alternating side rails between every other panel when folded. Also, while MacLean provides means for the adjustment of the slope of various sections, the relatively rigid panels do not allow any lateral slope to be installed. Further, the dowels and blocks used to adjust the elevation of different panels provide relatively limited adjustment, compared to the infinitesimally fine adjustment provided by the present threaded adjusters.

U.S. Pat. No. 3,858,887 issued on Jan. 7, 1975 to Karl L. Wallin describes a Miniature Golf Course comprising a plurality of generally radially disposed courses extending from a central hole area. Wallin specifies that his floor members and side members are all extremely rigid and that plural lengths are rigidly affixed to one another to form a rigid and inflexible course, unlike the flexible nature of the present invention. Also, Wallin permanently affixes the side rails to each of his floor panels, unlike the present invention. Further, the adjustment means provided by Wallin is directed to leveling the entire course over uneven terrain, and thus teaches away from providing variable slopes.

U.S. Pat. No. 3,892,412 issued on Jul. 1, 1975 to Bonny B. Koo describes a Putting Practice Green comprising a plurality of separate pneumatically inflatable pads, each secured to a rigid backing board. No side rails are provided by Koo to retain a ball laterally on the surfaces. Moreover, no connecting means are provided by Koo to secure the panels together, as are provided by the present invention. The simulated green overlay is not continuous, as in the present invention, and adjustment of the slope is cumbersome and time consuming, as several inflatable containers are provided in each pad, each of which must be inflated or deflated as desired when adjustment is to be made.

U.S. Pat. No. 4,875,682 issued on Oct. 24, 1989 to Michael Paolillo describes a Practice Putting Game comprising a rigid central area with symmetrical ball receiving areas (not holes) at each end thereof. The device is more akin to a game than to a simulated putting green, as the ball receiving areas are each divided into three compartments, with the central compartment including a plurality of vertically suspended, swinging rods which must be deflected by the ball for the ball to enter. Each of the ends is sloped rearwardly, away from the central surface, but the slope is fixed to retain the balls better thereon. The carpeting material is permanently bonded to the rigid base material, instead of being temporarily placed thereon as in the present invention. Also, Paolillo does not provide any side rails along the central portion of his device, as he does not teach the provision of any slope therealong which would tend to deflect the ball to the side.

U.S. Pat. No. 5,002,280 issued on Mar. 26, 1991 to Burl D. Hines describes an Adjustable And Folding Putting Green comprising only two longitudinal sections hingedly secured together, with a third hingedly attached section pivotable to a lateral position. The two longitudinal sections are hinged together along their bottom edges, resulting in at least a slight gap or seam between the separate sections of artificial turf even when the sections are extended. Hines provides for the adjustment of the level of the device but the adjusting levers do not provide infinite adjustment, as provided by the present invention, and are disposed beneath the edges of the playing surface, unlike the present invention. Also, Hines fails to provide any side rails along the edges of his device, which side rails are a part of the present invention.

U.S. Pat. No. 5,171,016 issued on Dec. 15, 1992 to Charles J. Kamal describes an Apparatus For Practicing Putting And Chipping, comprising two separable shallow box-like panels with a simulated grass or turf material removably secured thereover. Side panels are included only about one half of the device, rather than along the entire sides of the device as in the present invention. Thus, the side panels do nothing to secure the two portions together. The slope is adjustable, but only to a limited extent, as the device provides sloped internal passages for automated return of the ball, and excessive downward slope toward the hole would cancel the ball return slope. Also, the slope adjustment is by blocks of fixed thickness placed under the device, rather than by infinitely adjustable jackscrews extending above the surface.

U.S. Pat. No. 5,318,303 issued on Jun. 7, 1994 to Samuel Kim describes a Putting Green With Adjustable Topography And Multi-Ball Return. The device comprises several permanently secured, foldable sections which cannot be disassembled from one another, as in the present invention. At least one embodiment discloses side members which are pivotally secured together to allow the device to be folded, but the side members are permanently attached to the playing surface and to each other, unlike the separable components of the present invention. Moreover, the Kim slope adjustment means requires an overhead frame to carry a series of cords therethrough, which cords are attached to various points on the playing surface and are pulled to raise different points as desired. The frame must remain in place during play for slope adjustment, and tends to obscure the player's view of the surface. The area above the putting surface of the present invention, is completely devoid of any overlying structure, unlike the Kim device.

U.S. Pat. No. 5,429,368. issued on Jul. 4, 1995 to Thomas R. Adams describes a Portable Practice Putting Device comprising a plurality of panels which are permanently secured together by hinges. The simulated grass overlay is permanently attached to the underlying panels, unlike the present invention. The device is relatively small, and includes means to restrict the lateral travel of the putter head in order to "groove" the putting stroke. This is the primary object of the Adams device, as the short and narrow length and lack of provision for any slope, limit the device insofar as any realistic putting practice is concerned.

Finally, British Patent Publication No. 2,121,297 published on Dec. 21, 1983 to Declan T. Carolan describes a Putting Practice Unit comprising a pair of panels permanently hinged together. The simulated grass surface carpet material is permanently attached to the two panels. The device may provide for adjustable slope by means of a series of pivotally attached pegs which extend from channels which are clipped to the edges of the board. A separate surface is provided for the golfer to stand on. While the support pegs provide essentially infinite slope adjustment along the length of the surface, they are disposed below the surface, rather than above as in the present invention for convenience of adjustment. Moreover, the Carolan putting unit does not include any side rails, as provided by the present invention.

None of the above inventions and patents, taken either singly or in combination, is seen to describe the instant invention as claimed.

SUMMARY OF THE INVENTION

The present invention comprises a portable practice putting surface having a variable slope which is adjustable to the left, right, up, and down in the direction of the putt. The surface is formed of a plurality of separate panels, with a single continuous length of synthetic grass or turf material removably overlying the panels. The surface includes removable side rails for each of the panels, with the side rails including slope adjustment means therein for the various areas of the surface.

Accordingly, it is a principal object of the invention to provide an improved portable putting surface which enables a golfer to adjust the slope of the surface defined by the panels of the device, to provide single or multiple variations in the slope as desired.

It is another object of the invention to provide an improved portable putting surface which slope adjustment is provided by a plurality of threaded adjusters extending through the side rails of the device, allowing slope adjustment to be made from above the surface.

It is a further object of the invention to provide an improved portable putting surface which panels are secured together by means of the connected side rails, which are in turn secured to the panels of the device.

An additional object of the invention is to provide an improved portable putting surface which provides for infinitesimally small adjustments in slope, as desired.

Still another object of the invention is to provide an improved portable putting surface preferably formed of plastic, but which may be formed of wood or other materials as desired.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
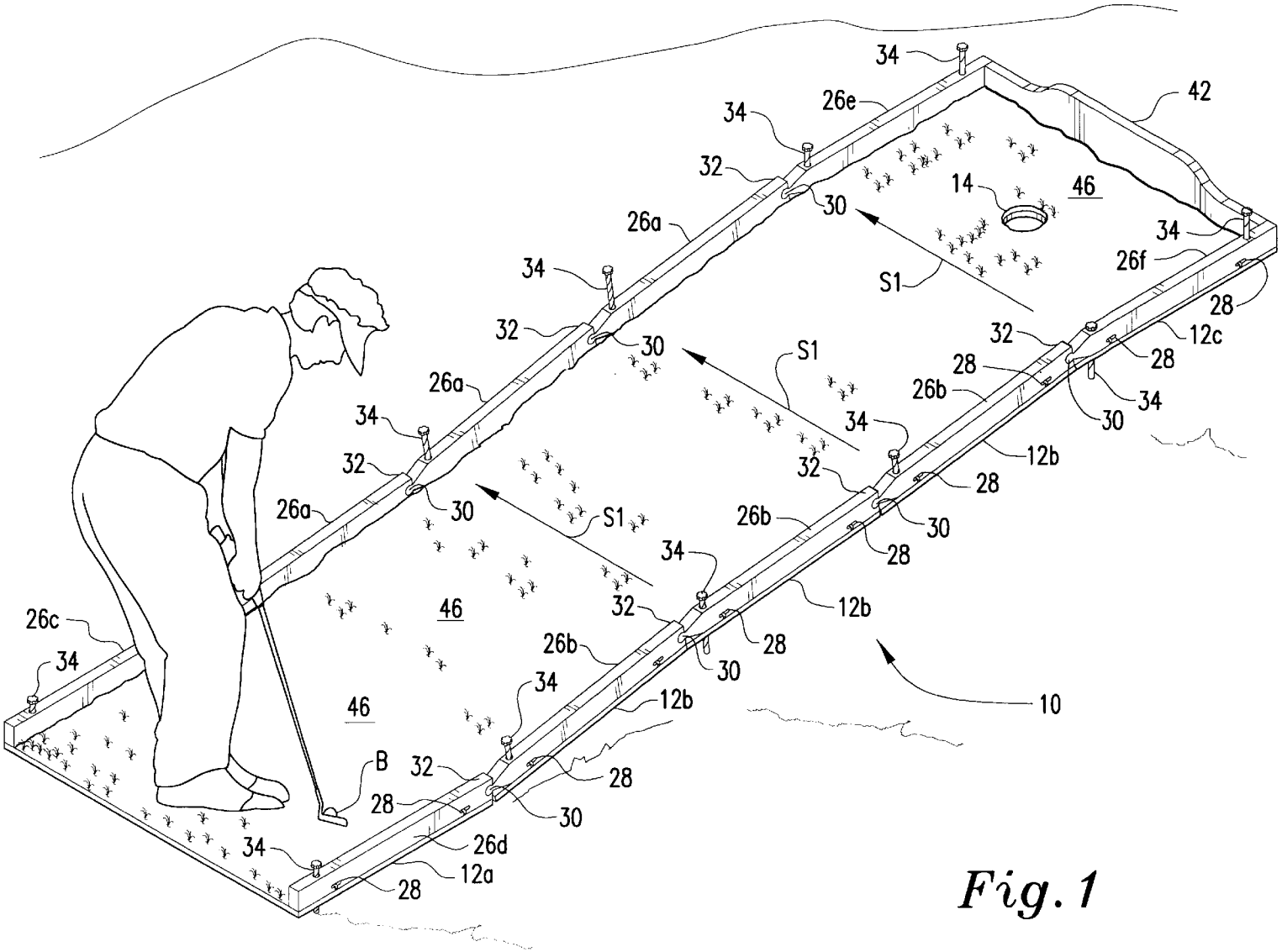
FIG. 1 is an environmental perspective view of the present portable putting surface in use, showing the adjustment of the surface to provide a variety of different slopes therein.

The present invention comprises a portable putting surface, generally designated by the reference numeral 10. FIG. 1 provides a perspective view of the present putting surface 10 in use, showing its adjustment to provide variation in slope to add realism and challenge to putting practice when using the present surface 10. The present surface 10 may be assembled for outdoor use, with the slope adjustment means used to compensate for slope in the natural terrain, or may be used indoors, with the slope adjustment means used to provide slope to the surface as desired.

Figure 2:
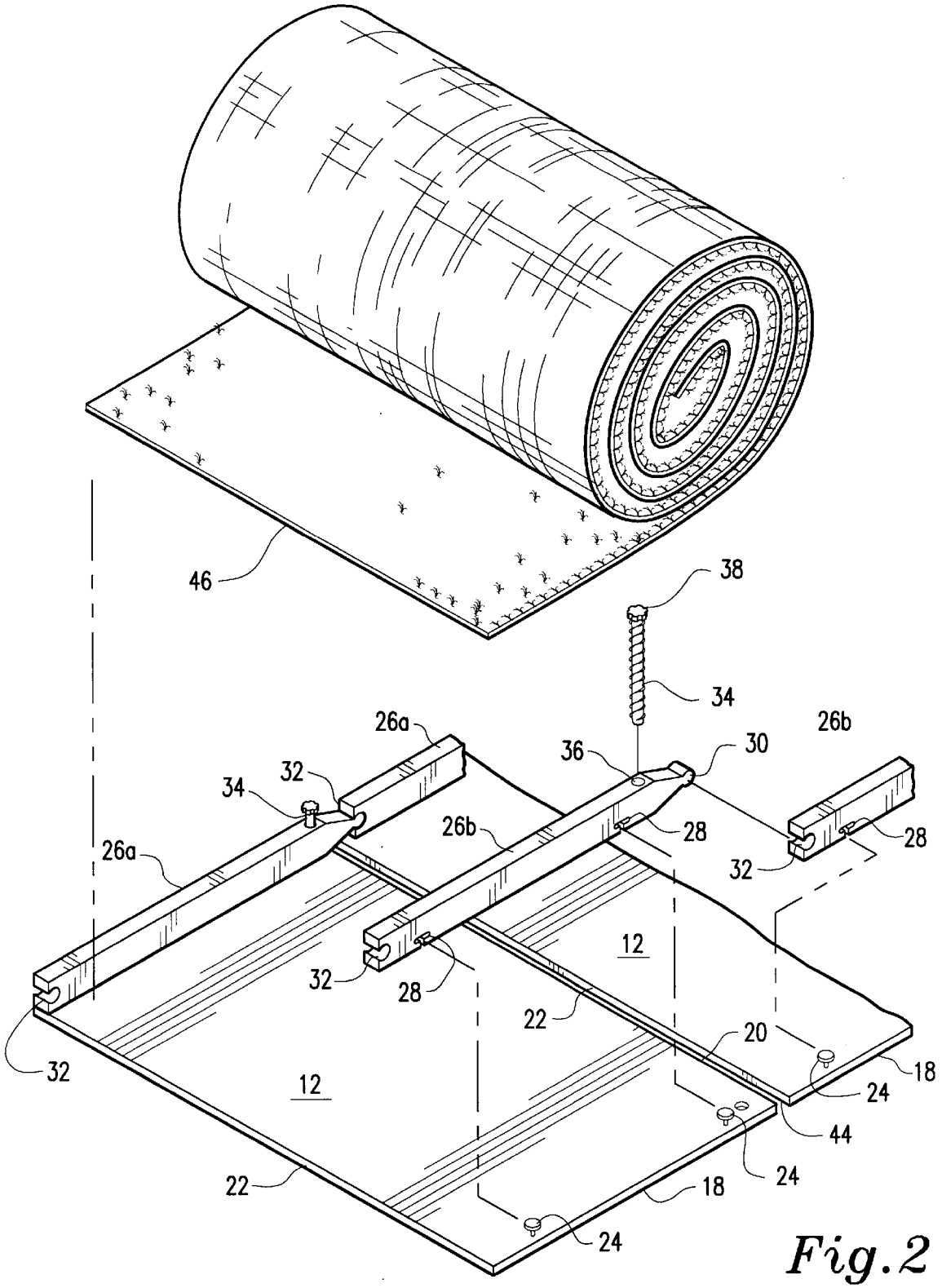
FIG. 2 is an exploded perspective showing details of the various components of the present invention and their assembly.

The putting surface 10 is formed of a series of separate flexible panels 12, as shown more clearly in the exploded perspective view of FIG. 2. The panels comprise a first panel 12*a,* a series of intermediate panels 12*b,* and an end panel 12*c* which includes a hole 14 therein for receiving a putted golf ball B when the present putting surface 10 is in use. Each of the panels 12 is identical to one another, with the exception of the end panel 12*c* containing the hole 14, having a left edge 16 (FIG. 4), an opposite and identical right edge 18, a forward edge 20, and an opposite rearward edge 22. Each of the panels 12 includes four upwardly extending side rail attachment fasteners 24, with two fasteners 24 closely adjacent the left edge 16 and another two fasteners 24 closely adjacent the right edge 18 of each panel 12. Each of the fasteners 24 has a generally T-shaped cross section (e.g., screw with screw head, etc.), for securing side rails (discussed immediately below) removably to the panels 12.

Figure 3:
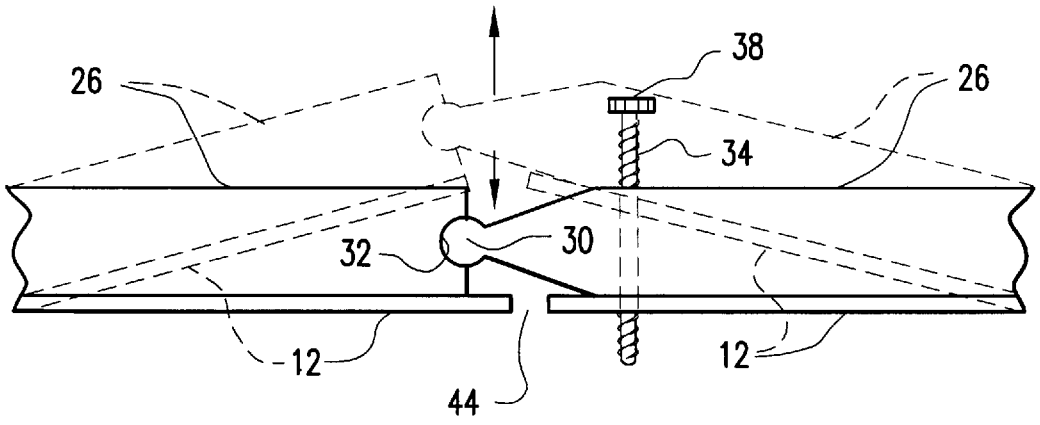
FIG. 3 is a detailed side elevation view of the connection joint between adjacent side rails of the present putting surface.

It will be seen in FIGS. 2 and 3 that any two adjacent panels 12 are not secured together directly to form the present putting surface 10. Rather, a plurality of removable side rails, comprising left side rails 26*a* and opposite right side rails 26*b,* are removably secured along the edges of the panels 12, with the rails 26*a*/26*b* in turn securing together to secure the panels 12 together as shown in FIG. 1. Preferably, the side rails 26*a* and 26*b* are mirror images of one another, due to the opposite attachment receptacle configuration formed in the different left and right side rails 26*a* and 26*b*.

Figure 4:
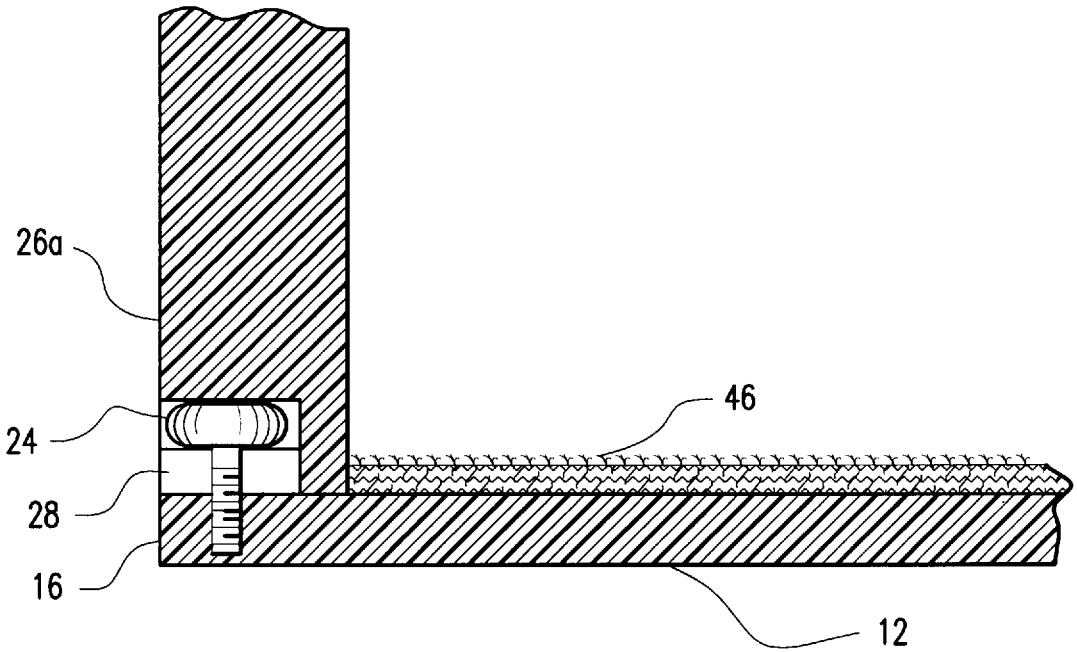
FIG. 4 is an elevation view in section of the means for securing the side rails to the surface panels of the present putting surface.

Each of the side rails 26*a* and 26*b* includes a T-shaped slot 28 formed therein, with the size, shape, and positions of the slots 28 being configured to fit closely about corresponding fasteners 24, as shown in FIG. 4. The slots 28 preferably do not extend completely through the thickness of the side rails 26, but rather are formed only partially therethrough from the outer surface of each of the side rails 26. The side rails 26*a*/26*b* are installed respectively along the left and right edges 16 and 18 of each of the panels 12 by placing them immediately inwardly from the corresponding fasteners 24 and aligned therewith, and pressing the side rails 26*a*/26*b* toward the respective outer edges 16/18 of the panels to engage with and seat over the fasteners 24. The provision of the slots 28 only partially through the side rails 26 thus acts as a stop to preclude further outward movement of the side rails, in the event they are accidentally kicked, hit with a putter head or ball, etc. However, it will be seen that the slots 28 may be formed completely through each of the side rails, if desired, thus making at least all of the intermediate side rails identical without concern for left or right members.

Each of the side rails 26 has a first end 30 and an opposite second end 32, with the two ends 30 and 32 providing removable and pivotable connection means between different side rails 26. The first end 30 may comprise a round hinge member extending therefrom, with the opposite second end. 32 comprising a round socket configured to fit closely about the hinge member end 30 of another side rail 26, as shown in detail in FIGS. 2 and 3.

The rounded configuration of the two mating ends 30 and 32 allows two connected side rails 26 to pivot about an axis through the joint formed by the connected mating ends 30 and 32, as shown in FIG. 3. The male rounded hinge member ends 30 each encompass somewhat more than 180 degrees of arc from their extended side rail. end, with the semicircular socket 32 of each mating side rail encompassing slightly more than 180 degrees of arc. Any two of the mating end components 30 and 32 may be easily assembled to and disassembled from one another by sliding the male end 30 sidewards into and from the female or socket end 32. Yet, the slightly greater than 180 degrees of circular arc of the two components. assures that the end 30 cannot pull straight out from the mating socket end 32, thus securing any two of the side rails 26 together and allowing them to pivot or move arcuately relative to one another.

All of the side rails may be constructed as described above, if so desired. However, it will be seen that the socket and mating male rounded ends are not required for those ends which are adjacent the forward edge of the first panel 12*a,* and the rearward edge of the end panel 12*c*. In FIG. 1, these side rails, respectively side rails 26*c,* 26*d,* 26*e,* and 26*f,* are shown accordingly. However, the present invention will still function as described if only two types of side rails, i. e., side rails 26*a* and 26*b,* are provided, with those side rails also being used as side rails for the two end panels 12*a* and 12*b,* without their respective first and second ends being connected to other elements.

As noted further above, the present portable putting surface 10 is adjustable to provide different slopes as desired. The series of panels 12 may be adjusted by adjusting means installed through the side rails 26, to provide either forward, rearward, left, or right slope, or any combination thereof, as desired. The adjusting means comprises a plurality of steeply threaded jackscrews 34 or the like, with a corresponding number of mating threaded passages 36 formed generally vertically through each of the side rails 26 adjacent their first ends. The passages 36 may comprise inserts which are permanently molded or otherwise secured in place within the side rails, as shown in FIG. 5, or may be formed directly within the material comprising the side rails 26 as desired.

Figure 5:
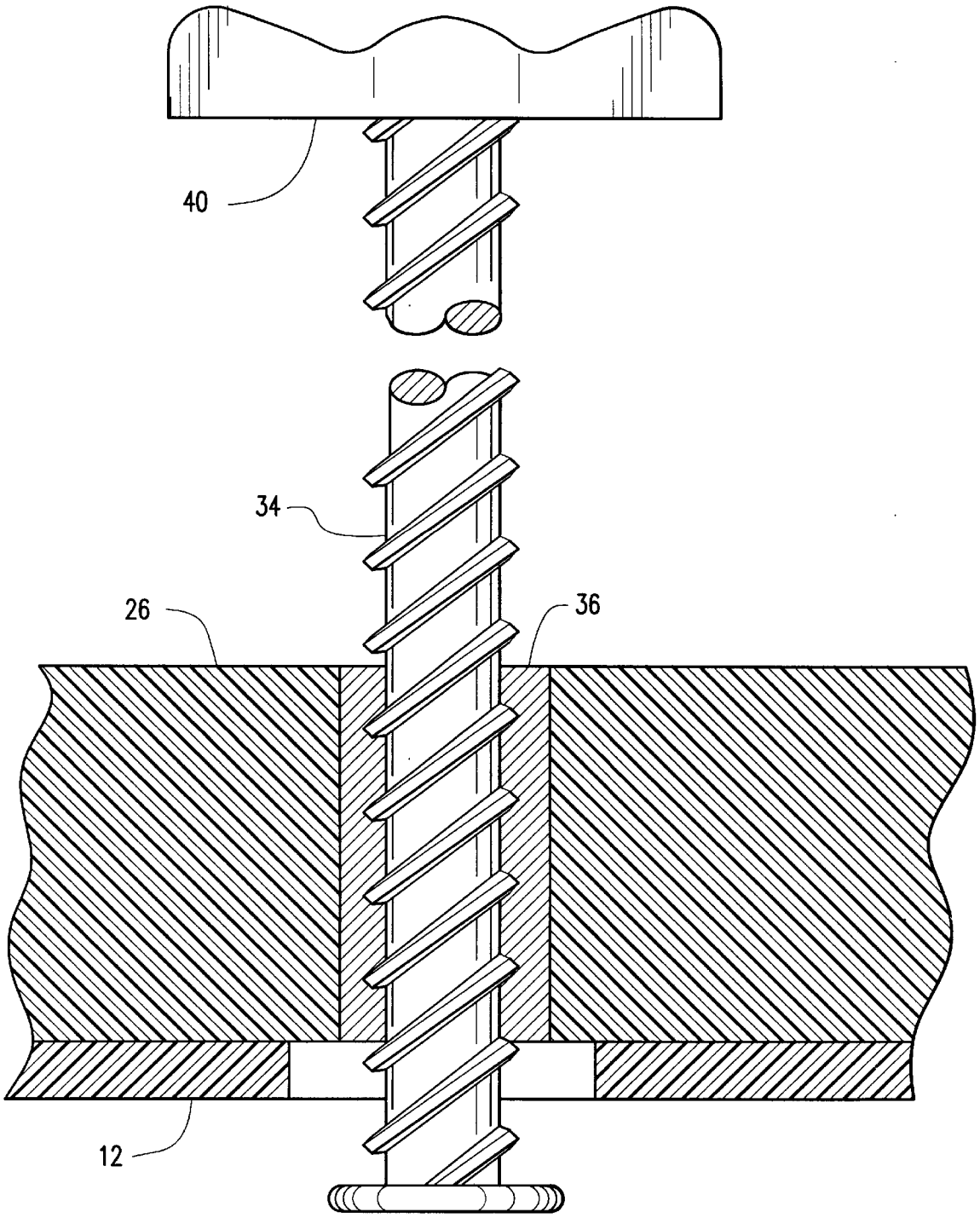
FIG. 5 is an elevation view in section of the slope adjustment means of the present putting surface.

Preferably, the jackscrews 34 and mating passages 36 are formed with a steeply pitched thread to provide a relatively large advance per turn, as shown by the threads particularly in FIG. 5. As the present panels 12 are preferably on the order of three feet wide (other dimensions may be used), one inch of advance would provide a slope of 1:36, or slightly less than two degrees. Hence, a pitch of ⅓ or even ½ inch per screw turn would still provide sufficiently fine adjustment for the purposes of the present invention. Yet, the continuous advance possible by using such threaded components allows infinitesimally small increments to be made in adjusting the slope of the present putting surface 10. The jackscrews 34 may be provided with some form of handle means, e.g. the knurled knobs 38 of FIGS. 2 and 3 or the thumbscrew 40 of FIG. 5.

The present portable putting surface 10 is assembled for use by first installing the left and right side rails 26*a* and 26*b*

(and 26*c, d, e,* and *f,* if those special end components are provided) to the fasteners 24 which are permanently installed along the left and right edges 16 and 18 of the panels 12. The side rails 26 are preferably installed from the inside of each panel 12, toward the. outer edge, with the slots 28 formed partially through each of the rails 26 serving as stops to preclude movement of the rails outwardly past the edges of the panels 12 once installed. An end rail 42 may then be installed across the end panel 12*c* having the hole 14 therein, with the attachment means being the same as that described for the other side rails 26. The end rail 42 retains. putted golf balls on the present surface 12, preventing their escape past the last or end panel 12*c* if the hole 14 is missed.

After the side rails 26 and end rail 42 are installed to the appropriate panels 12, the rails 26 are connected to one another by sliding the rounded knob or hinge 30 comprising the first end of each of the rails 26, laterally into the mating slots 32 of the second end of each of the rails 26, for each pair of rails 26 installed along the edges of each of the panels 12. (It should be noted that the rails 26 may be turned around end for end, if desired, as shown in FIG. 2.) The completed assembly leaves a slight gap 44 between adjacent panel ends, as shown in FIGS. 2 and 3, to allow space for the panel edges to approach one another as the slope of the panels is raised and the attached side rails 26 pivot about their mating ends 30 and 32.

The assembled surface is then covered with an overlay of simulated grass or turf material 46, such as Astroturf (tm) or other synthetic material providing a reasonable simulation of the closely mowed grass surface of a golf green. Other covering materials may be substituted, if so desired. The overlay 46 is preferably cut to have a width which fits closely between the opposite side rails 26*a* and 26*b,* and has a length sufficient to provide a continuous, unbroken span extending from the forward edge of the first panel 12*a* to the end rail 42 attached to the end panel 12*c*. The overlay includes a hole therethrough, congruent with the hole 14 of the panel 12*c* for receiving a putted golf ball.

At this point, a golfer may adjust the slope of the various panels as desired, by adjusting one or more of the various jackscrews 34 downwardly or upwardly through their respective passages or inserts 36, as desired. For example, the putting surface 10 of FIG. 1 has been adjusted to provide a downward left slope S1 by turning the right side jackscrews 34 down and into the right side rails 26*b,* as indicated by the relatively short length of the jackscrews 34 extending above the right side rails 26*b* along the central area of the surface 10, in comparison to the jackscrews 34 extending higher above the left side rails 26*a* in this area. A further examination of FIG. 1 will show that the jackscrews 34 along each connected length of side rails 26*a* and 26*b* are adjusted unevenly to provide additional variations in the slope of the surface, as desired by a golfer using the present surface 10.

In summary, the present portable putting surface 10 provides a most realistic means of duplicating a particular lie on a specific golf green, and/or for setting up varying slopes as desired to add challenge to practice putting. The variable slope adjustment means provided may also be used to level the surface in the event that it is assembled outdoors over uneven terrain. The ease of assembly of the present putting surface, without need for tools of any kind, assures that the surface will see reasonable use whenever a golfer has more than a few minutes of free time but cannot spare the time to visit his or her local golf course.

The present portable putting surface will also be seen to provide a most useful accessory for golf teaching professionals, in that the device may be used to teach an appreciation for different side hill lies and slopes when putting, for use indoors during inclement weather or when suitable conditions are not readily available. Thus, golf teaching professionals may make better use of their time when conditions are not suitable for outdoor play on the actual golf fairway and green surfaces.

In addition to the above, it will be seen that one or more of the side rail 26 or end rail 42 components or other obstacles may be placed atop the artificial turf overlay 46 as desired, to obstruct partially the direct line to the hole 14. Thus, the present portable putting surface may be configured to resemble many holes commonly seen on a miniature golf course, to provide a putting challenge for families during inclement weather, or for outdoor parties, etc., as desired.

The various components may be formed of virtually any suitable material, with the panels 12 and rails 26 and 42 being preferably formed of plastic for durability, light weight, and the required flexibility of the panels 12 to allow various slopes to be formed therein. Other materials, such as wood and metal sheet and extrusions, may be used if so desired. The relatively flexible nature of the artificial turf material 46 assists in smoothing out the relatively sharp breaks in contour and small gaps between adjacent panels 12, by curving smoothly over the adjacent panel. edges to simulate more accurately the gently rolling terrain of a real golf green. Thus, the present portable putting surface will provide golfers using the device with an economical and quite useful means of keeping their putting game sharp at all times.

It is to be understood that the present invention is not limited to the sole embodiment described above, but encompasses any and all embodiments within the scope of the following claims.

We claim:

1. A portable putting surface, comprising:

a plurality of separate flexible panels, each having a left edge, an opposite right edge, a forward edge, and an opposite rearward edge;

said panels including an end panel having a hole therein for accepting a putted golf ball;

a corresponding plurality of left and right side rails, for removable attachment respectively to said left edge and said right edge of each of said panels;

each of said side rails having a first end and an opposite second end, with each of said side rails including means for removably and adjustably connecting at least one said end thereof to at least one said end of another of said side rails;

each of said side rails further including means for adjusting the slope of each of said panels forwardly, rearwardly, left, and right; and a single, continuous length of artificial turf material for removable placement over all of said panels for simulating a golf green, with said artificial turf material having a width equal to said panels between said side rails, a length equal to said plurality of panels when laid end to end, and a hole therethrough congruent with said hole in one of said panels for accepting a putted golf ball.

2. The portable putting surface according to claim 1, wherein each of said panels includes at least two side rail fasteners extending upwardly from separate points immediately inward from said left edge and said right edge thereof, with each of said fasteners having a T-shaped cross section; and each of said side rails includes a corresponding number of slots therein, with each of said slots having a T-shaped cross section and positioned and configured to fit tightly about one of said fasteners to secure said side rails to said panels.

3. The portable putting surface according to claim 1, wherein said first end of each of said side rails includes a round first hinge member extending therefrom, and said second end of each of said side rails includes a round socket formed therein for accepting one said round hinge member pivotally therein.

4. The portable putting surface according to claim 1, wherein said means for adjusting the slope of each of said panels comprises a threaded slope adjustment screw engaging a mating threaded passage extending from top to bottom through at least one end of each of said side rails adjacent one said end thereof for adjusting the slope of each of said panels in infinitesimally small increments as desired, with each said slope adjustment screw including an upper end with handle means disposed thereon above a respective one of said side rails.

5. The portable putting surface according to claim 1, wherein said side rails include a plurality of left intermediate and right intermediate side rails, with each of said left intermediate side rails being identical to one another and each of said right intermediate side rails being identical to one another, and said panels include a first panel and a plurality of intermediate panels, with said first panel and each of said intermediate panels being identical to one another.

6. The portable putting surface according to claim 1, including an end rail for installing across said end panel, for retaining a golf ball on said artificial turf material.

7. The portable putting surface according to claim 1, wherein at least said panels and said side rails are formed of plastic material.

8. A portable putting surface, comprising:

a plurality of separate flexible panels, each having a left edge, an opposite right edge, a forward edge, and an opposite rearward edge;

said panels including an end panel having a hole therein for accepting a putted golf ball;

each of said panels including a left and a right side rail removably secured thereto;

each of said left side rails and said right side rails being removably connected respectively to another of said left side rails and said right side rails for adjustably securing said panels together;

a single, continuous length of artificial turf material overlying all of said panels for simulating a golf green, with said artificial turf material having a width equal to said panels between said side rails, a length equal to said plurality of panels when laid end to end, and a hole therethrough congruent with said hole in one of said panels for accepting a putted golf ball; and each of said side rails further including means for adjusting the slope of each of said panels forwardly, rearwardly, left, and right.

9. The portable putting surface according to claim 8, wherein each of said panels includes at least two side rail fasteners extending upwardly from separate points immediately inward from said left edge and said right edge thereof, with each of said fasteners having a T-shaped cross section; and each of said side rails includes a corresponding number of slots therein, with each of said slots having a T-shaped cross section and positioned and configured to fit tightly about one of said fasteners to secure said side rails to said panels.

10. The portable putting surface according to claim 8, wherein said side rails include a plurality of intermediate side rails, with said first end of at least each of said intermediate side rails including a round first hinge member extending therefrom, and said second end of at least each of said intermediate side rails including a round socket formed therein removably and pivotally connected to a respective said first hinge member.

11. The portable putting surface according to claim 8, wherein said means for adjusting the slope of each of said panels comprises a threaded slope adjustment screw engaging a mating threaded passage extending from top to bottom through at least one end of each of said side rails adjacent one said end thereof for adjusting the slope of each of said panels in infinitesimally small increments as desired, with each said slope adjustment screw including an upper end with handle means disposed thereon above a respective one of said side rails.

12. The portable putting surface according to claim 8, wherein said side rails include a plurality of left intermediate and right intermediate side rails, with each of said left intermediate side rails being identical to one another and each of said right intermediate side rails being identical to one another, and said panels include a first panel and a plurality of intermediate panels, with said first panel and each of said intermediate panels being identical to one another.

13. The portable putting surface according to claim 8, including an end rail disposed across said end panel, for retaining a golf ball on said artificial turf material.

14. The portable putting surface according to claim 8, wherein at least said panels and said side rails are formed of plastic material.

* * * * *